US011685976B2

(12) United States Patent
Tan et al.

(10) Patent No.: US 11,685,976 B2
(45) Date of Patent: Jun. 27, 2023

(54) METHOD FOR PREPARING AMORPHOUS PARTICLE-MODIFIED MAGNESIUM ALLOY SURFACE-GRADIENT COMPOSITES

(71) Applicant: Chongqing University, Chongqing (CN)

(72) Inventors: Jun Tan, Chongqing (CN); Jiaxing Peng, Chongqing (CN); Jiarong Gao, Chongqing (CN); Hang Zhou, Chongqing (CN); Yiming Chen, Anxiang (CN); Jianbo Li, Chongqing (CN); Xianhua Chen, Chongqing (CN); Fusheng Pan, Chongqing (CN)

(73) Assignee: Chongqing University, Chongqing (CN)

( * ) Notice: Subject to any disclaimer, the term of this patent is extended or adjusted under 35 U.S.C. 154(b) by 0 days.

(21) Appl. No.: 18/077,256

(22) Filed: Dec. 8, 2022

(65) Prior Publication Data

US 2023/0100782 A1 Mar. 30, 2023

(30) Foreign Application Priority Data

Dec. 20, 2021 (CN) ..... 202111558992.6

(51) Int. Cl.

| | |
|---|---|
| ***C22C 23/04*** | (2006.01) |
| ***C22C 1/03*** | (2006.01) |
| ***C22C 1/11*** | (2023.01) |

(52) U.S. Cl.

CPC ..... *C22C 23/04* (2013.01); *C22C 1/03* (2013.01); *C22C 1/11* (2023.01)

(58) Field of Classification Search

CPC ..... C22C 23/04

See application file for complete search history.

(56) References Cited

U.S. PATENT DOCUMENTS

| | | | |
|---|---|---|---|
| 2018/0371583 | A1 | 12/2018 | Mizutani et al. |
| 2021/0220898 | A1 | 7/2021 | Ma et al. |
| 2021/0222272 | A1 | 7/2021 | Ma et al. |

FOREIGN PATENT DOCUMENTS

| | | | |
|---|---|---|---|
| CN | 113493876 | A * | 10/2021 |

OTHER PUBLICATIONS

Yang, et al., Influence of alloying elements on hot tearing susceptibility of Mg—Zn alloys based on thermodynamic calculation and experimental, Journal of Magnesium and Alloys vol. 6, Issue 1, Mar. 2018, pp. 44-51 (Year: 2018).*

* cited by examiner

*Primary Examiner* — Christopher S Kessler
(74) *Attorney, Agent, or Firm* — Jeenam Park

(57) ABSTRACT

The invention relates to a method for preparing amorphous particle-modified magnesium alloy surface-gradient composites and pertains to the technical field of composites. The method comprises steps of: holding the temperature at 150~350° C. for FeCrMoBC amorphous alloy particles; mixing pure magnesium, pure zinc, pure aluminum, pure copper and Mg-5 wt % Mn alloy under continuous protective gases, gradually raising temperature to 720~760° C. and melting at a constant temperature for 15~25 min to obtain a magnesium alloy melt; cooling the magnesium alloy melt to 600~635° C. and starting mechanical stirring; continuing the cooling until the semi-solid temperature is 570~615° C., slowly adding the above FeCrMoBC amorphous alloy particles, holding for 2~5 min after mixing evenly, and cooling the crucible with water to obtain an amorphous particle-modified magnesium alloy surface-gradient composite.

5 Claims, 5 Drawing Sheets

METHOD FOR PREPARING AMORPHOUS PARTICLE-MODIFIED MAGNESIUM ALLOY SURFACE-GRADIENT COMPOSITES

TECHNICAL FIELD

The present invention relates to a method for preparing amorphous particle-modified magnesium alloy surface-gradient composites and pertains to the technical field of composite materials.

BACKGROUND ART

A gradient composite is made of materials of different properties through a specific manufacturing technology and process according to specific operating requirements to achieve certain gradient changes in composition and structure inside the materials, so that the corresponding physical and chemical properties also show the corresponding continuous changes. Among the gradient composites, the metal-matrix gradient composites assume an important position in the research field of gradient composites owing to their good mechanical and processing properties. Currently, the metal-matrix gradient composites preparation processes are classified into the following few categories: powder metallurgy method, vapor deposition method, thermal spray method, self-propagating high-temperature synthesis method, casting method, ultrasonic method, laser method, and electromagnetic method.

In the prior art, particle-reinforced gradient composites are prepared by adding a certain proportion of high-hardness non-metallic particles to molten liquid metal, and applying an external electromagnetic field, in which the liquid metal moves in a fixed direction and the reinforcing particles move opposite to the flow direction of the liquid metal, thereby achieving a gradient distribution of the reinforcing particles in the material to realize gradient changes in properties; the reinforcement phase metal composite material manufacturing process and equipment are to fix reinforcement alloy powder briquettes to specific positions of a plastic foam mold for vacuum negative-pressure vibration molding, heat the alloy paste inside the mold by an electromagnetic induction heater installed outside the mold, and cast matrix metal liquid after reaching certain temperature. The metal liquid permeates to the gaps of alloy powder. After cooling, a gradient composite with special properties is formed at specific locations on the surface of the matrix metal; in a device and method for preparing particle-reinforced gradient composites by ultrasonic wave, whose ultrasonic wave generator is located in the lower part of a container. The matrix metal material is heated and melted in the container. When it is in a state of liquid metal, reinforcing particles are added and meanwhile, the ultrasonic wave generator is started to apply ultrasonic wave for a period of time and then the heating is stopped and the material is cooled and solidified, thereby obtaining a particle-reinforced gradient composite.

However, the current preparation method features a complex process and high requirements for equipment. Meanwhile, the prepared gradient materials have poor dispersibility, low controllability, and high cost, so they are not suitable for large-scale industrial application.

SUMMARY OF THE INVENTION

The present invention provides a method for preparing amorphous particle-modified magnesium alloy surface-gradient composites to address the problems with the preparation of particle-reinforced gradient composites in the prior art. Reinforcement phase, like FeCrMoBC amorphous alloy particle, shows a gradient distribution in the magnesium alloy matrix, and their properties and structure also show gradient changes. The width of the outer layer and the transition composite layer is mainly decided by the amount of the reinforcement phase, holding time, and solidification temperature; meanwhile, FeCrMoBC amorphous alloy particles are well bonded with the magnesium alloy matrix and show desirable continuous changes in the alloy matrix.

A method for amorphous particle-modified magnesium alloy surface-gradient composites, comprising steps of:

(1) weighing pure magnesium, pure zinc, pure aluminum, pure copper, Mg-5 wt % Mn alloy, and FeCrMoBC amorphous alloy particles;

(2) holding the temperature at 150~350° C. for the FeCrMoBC amorphous alloy particles weighed at step (1);

(3) mixing the pure magnesium, pure zinc, pure aluminum, pure copper, and Mg-5 wt % Mn alloy weighed at step (1), putting the mixture in a melting and heating furnace under continuous protective gases, gradually raising temperature to 720~760° C. and melting at a constant temperature for 15~25 min to obtain a magnesium alloy melt; and (4) cooling the magnesium alloy melt obtained at step (3) to 600~635° C., starting mechanical stirring till the temperature is cooled to 570~615° C., slowly adding the FeCrMoBC amorphous alloy particles obtained at step (2), holding for 2~5 min after mixing evenly, and cooling the crucible with water to obtain an amorphous particle-modified magnesium alloy surface-gradient composite.

Supposing that the total mass of the raw materials at step (1) is 100%, the pure magnesium is 72.85~85.35%, the pure zinc is 7.50~8.50%, the pure aluminum is 0.65~9.50%, the pure copper is 0.45~0.55%, the Mg-5 wt % Mn alloy is 9.0~11.0%, and the FeCrMoBC amorphous alloy particles are 2.00~8.00%;

The protective gases at step (3) are mixed gases of $CO_2$ and $SF_6$;

The volume fraction of $CO_2$ in the protective gases at step (3) is 99%;

The mechanical stirring speed at step (3) is 350~1000 rpm.

The present invention has the following advantages:

(1) The present invention uses an iron-based amorphous particle-modified magnesium alloy prepared by the semi-solid stir casting method. The iron-based amorphous particles are well bonded with the magnesium alloy matrix, close to the requirements of the final castings and reducing the processing of subsequent processes;

(2) The present invention obtains amorphous particle-modified magnesium alloy surface-gradient composites in different thickness (outer layer and transition layer) through different amount of the iron-based amorphous alloy, semi-solid temperature (T50), stirring speed, and holding time;

(3) In the present invention, the reinforcement phase FeCrMoBC amorphous alloy particles show a gradient distribution in the magnesium alloy matrix, and their properties and structure also show gradient changes. The width of the outer layer and the transition composite layer is mainly decided by the amount of the reinforcement phase, holding time, and solidification temperature; meanwhile, FeCrMoBC amorphous alloy particles are well bonded with the magnesium alloy matrix and show desirable continuous changes in the alloy matrix; the magnesium alloy surface has high hardness, strength and wear resistance, and meanwhile, with the extension to the transition and inner layers of the alloy, the properties also show continuous changes;

(4) The method provided by the present invention is nested in the conventional casting process, features easy operation and low cost and is applicable to a number of magnesium alloy systems and industrial production and promotion can be easily realized.

DETAILED DESCRIPTION

The present invention will be further described in detail below in conjunction with specific embodiments, but the scope of protection of the present invention is not limited to the contents below.

Figure 1:
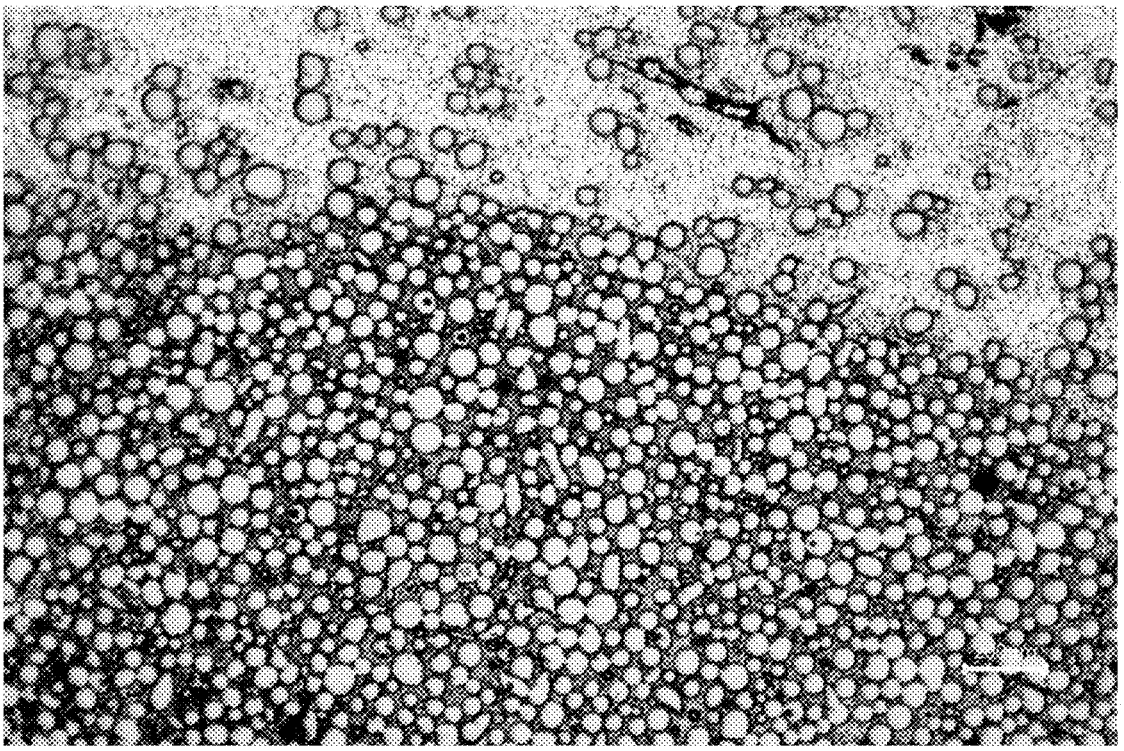
FIG. 1 is a microstructure diagram of an amorphous particle-modified AZ91 surface-gradient composite in Embodiment 1.
Figure 2:
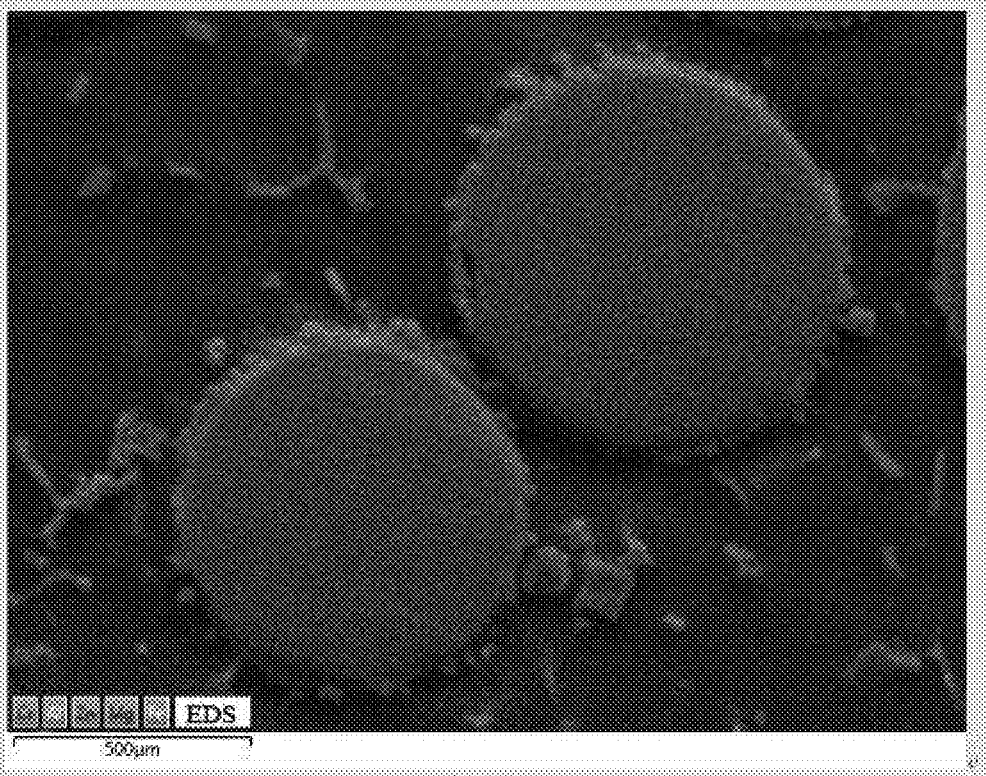
FIG. 2 is an EDS diagram of an amorphous particle-modified AZ91 surface-gradient composite in Embodiment 1.

Embodiment 1: A method for preparing an amorphous particle-modified AZ91 magnesium alloy surface-gradient composite, with steps of:

(1) weighing pure magnesium, pure zinc, pure aluminum, Mg-5 wt % Mn alloy, and FeCrMoBC amorphous alloy particles, wherein supposing that the total mass of the raw materials is 100%, the pure magnesium is 73.60%, the pure aluminum is 9.50%, the pure zinc is 0.90%, the Mg-5 wt % Mn alloy is 8.00%, and the FeCrMoBC amorphous alloy particles are 8.00%;

(2) holding the temperature at 300° C. for the FeCrMoBC amorphous alloy particles weighed at step (1);

(3) mixing the pure magnesium, pure zinc, pure aluminum, and Mg-5 wt % Mn alloy weighed at step (1), putting the mixture in a melting and heating furnace under continuous protective gases (mixed gases of $CO_2$ and $SF_6$), gradually raising temperature to 760° C. and melting at a constant temperature for 20 min to obtain a magnesium alloy melt, wherein the volume fraction of $CO_2$ in the protective gases is 99%; and (4) cooling the magnesium alloy melt at step (3) to 600° C., starting mechanical stirring (the stirring speed is 1,000 rpm), continuing to cool it to 570° C., slowly adding the FeCrMoBC amorphous alloy particles obtained at step (2), holding for 3 min after mixing evenly, and cooling the crucible with water to obtain an amorphous particle-modified AZ91 magnesium alloy surface-gradient composite;

The microstructure diagram of the amorphous particle-modified ZA91 surface-gradient composite in this embodiment is shown in FIG. 1, and the EDS diagram of the amorphous particle-modified ZA91 surface-gradient composite is shown in FIG. 2. From FIG. 1 and FIG. 2, it can be known that the amorphous particles show a gradient distribution in the alloy matrix and the interfacial bonding is good.

Figure 3:
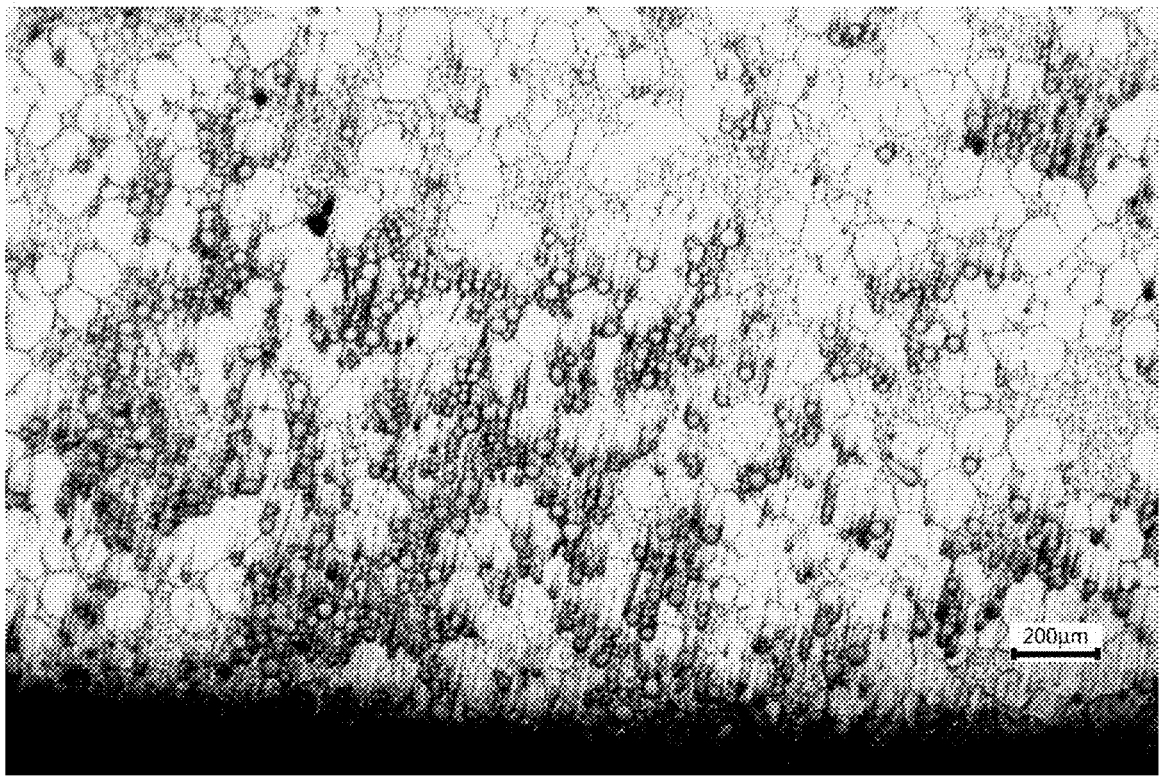
FIG. 3 is a microstructure diagram of an amorphous particle-modified AM50 surface-gradient composite in Embodiment 2.

Embodiment 2: A method for preparing an amorphous particle-modified AM50 magnesium alloy surface-gradient composite, with steps of:

(1) weighing pure magnesium, pure zinc, pure aluminum, Mg-5 wt % Mn alloy, and FeCrMoBC amorphous alloy particles, wherein supposing that the total mass of the raw materials is 100%, then the pure magnesium is 82.70%, the pure aluminum is 5.00%, the pure zinc is 0.30%, the Mg-5 wt % Mn alloy is 10.00%, and the FeCrMoBC amorphous alloy particles are 2.00%;

(2) holding the temperature at 250° C. for the FeCrMoBC amorphous alloy particles weighed at step (1);

(3) mixing the pure magnesium, pure zinc, pure aluminum, and Mg-5 wt % Mn alloy weighed at step (1), putting the mixture in a melting and heating furnace under continuous protective gases (mixed gases of $CO_2$ and $SF_6$), gradually raising temperature to 720° C. and smelting at constant temperature for 20 min to obtain a magnesium alloy melt, wherein the volume fraction of $CO_2$ in the protective gases is 99%; and (4) cooling the magnesium alloy melt at step (3) to 625° C., starting mechanical stirring (the stirring speed is 350 rpm), continuing to cool it to 605° C., slowly adding the FeCrMoBC amorphous alloy particles obtained at step (2), holding for 3 min after mixing evenly, and cooling the crucible with water to obtain an amorphous particle-modified AM50 magnesium alloy surface-gradient composite;

The microstructure diagram of the amorphous particle-modified AM50 surface-gradient composite in this embodiment is shown in FIG. 3. From FIG. 3, it can be known that the amorphous particles show a gradient distribution at the bottom and good dispersibility in the same layer.

Figure 4:
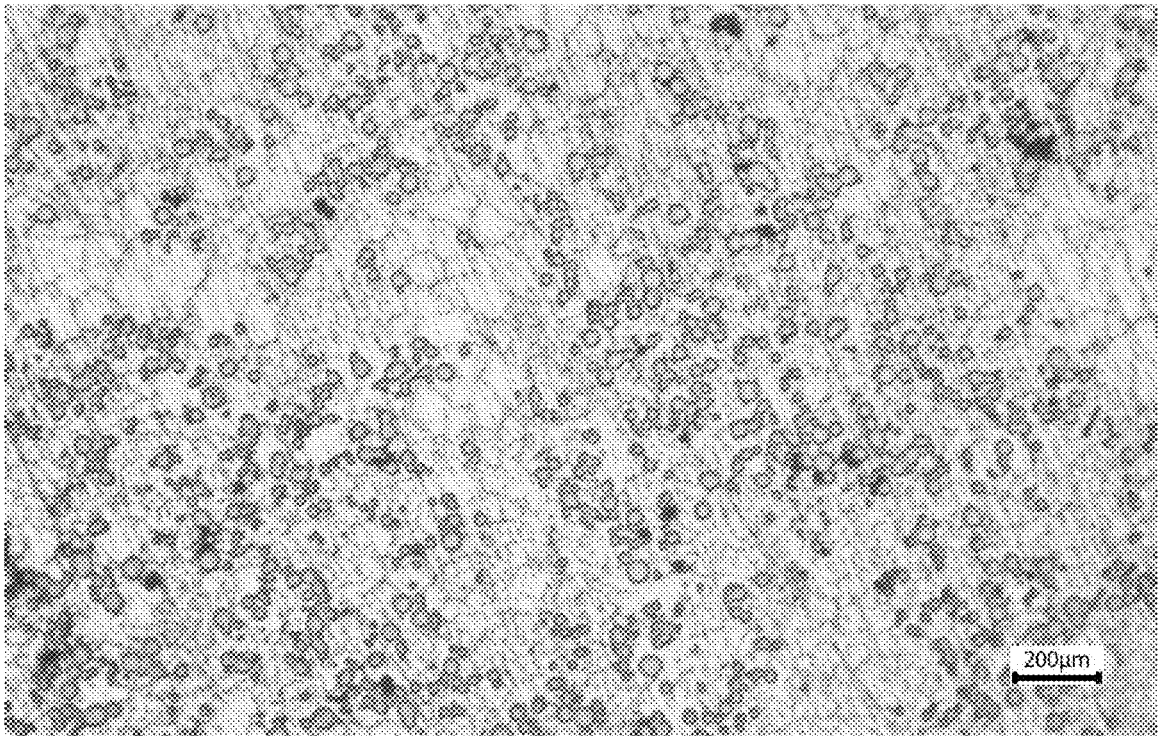
FIG. 4 is a microstructure diagram of an amorphous particle-modified AM60 surface-gradient composite in Embodiment 3.

Embodiment 3: A method for preparing an amorphous particle-modified AM60 magnesium alloy surface-gradient composites, with steps of:

(1) weighing pure magnesium, pure zinc, pure aluminum, Mg-5 wt % Mn alloy, and FeCrMoBC amorphous alloy particles, wherein supposing that the total mass of the raw materials is 100%, then the pure magnesium is 78.70%, the pure aluminum is 5.00%, the pure zinc is 0.30%, Mg-5 wt % Mn alloy is 10.00%, and the FeCrMoBC amorphous alloy particles are 6.00%;

(2) holding the temperature at 250° C. for the FeCrMoBC amorphous alloy particles weighed at step (1);

(3) mixing the pure magnesium, pure zinc, pure aluminum and Mg-5 wt % Mn alloy weighed at step (1), putting the mixture in a smelting and heating furnace under continuous protective gases (mixed gases of $CO_2$ and $SF_6$), gradually raising temperature to 720° C. and smelting at constant temperature for 20 min to obtain a magnesium alloy melt, wherein the volume fraction of $CO_2$ in the protective gases is 99%; and (4) cooling the magnesium alloy melt at step (3) to 620° C., starting mechanical stirring (the stirring speed is 350 rpm), continuing to cool it to 600° C., slowly adding the FeCrMoBC amorphous alloy particles obtained at step (2), holding for 2 min after mixing evenly, and cooling the crucible with water to obtain an amorphous particle-modified AM60 magnesium alloy surface-gradient composite;

The microstructure diagram of the amorphous particle-modified AM60 surface-gradient composite in this embodiment is shown in FIG. 4. From FIG. 4, it can be known that a good gradient distribution is shown along the gravity direction, and the dispersibility is good, too.

Figure 5:
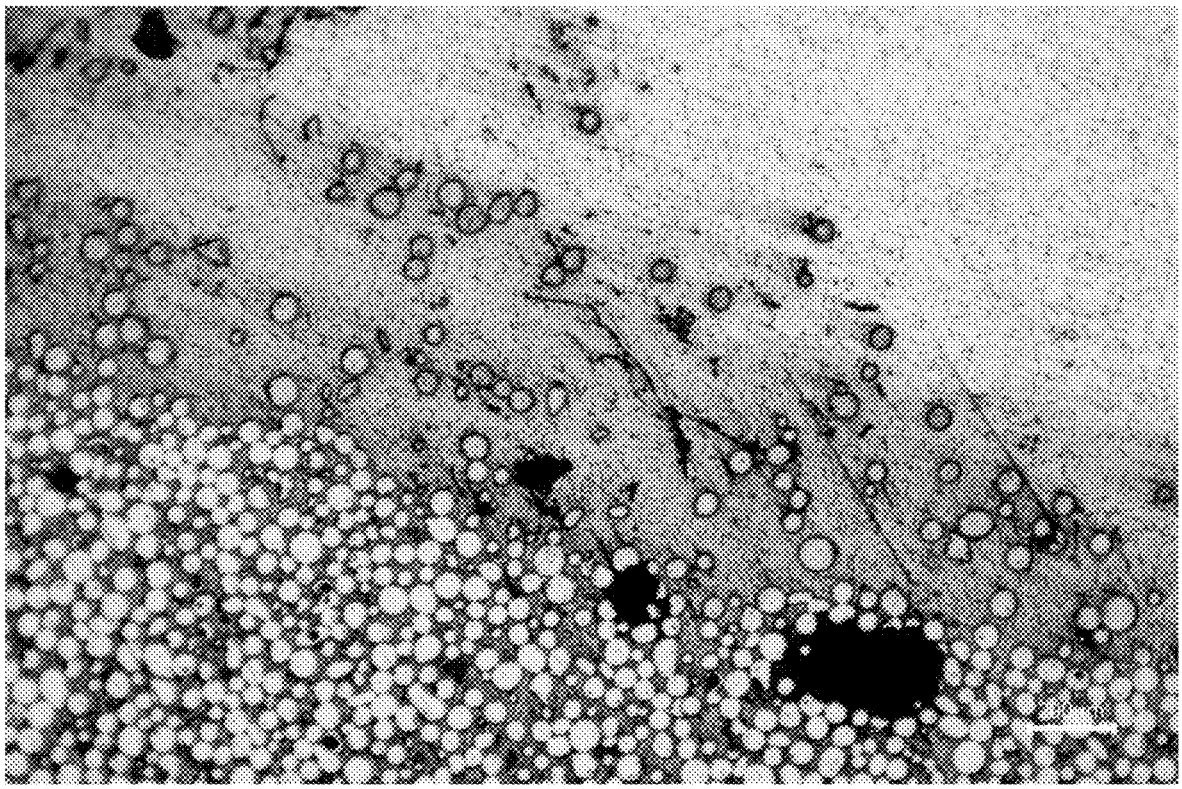
FIG. 5 is a microstructure diagram of an amorphous particle-modified ZA81 surface-gradient composite in Embodiment 4.

Embodiment 4: A method for preparing an amorphous particle-modified ZA81 magnesium alloy surface-gradient composite, with steps of:

(1) weighing pure magnesium, pure zinc, pure aluminum, pure copper, Mg-5 wt % Mn alloy, and FeCrMoBC amorphous alloy particles, wherein supposing that the total mass of the raw materials is 100%, then the pure magnesium is 75.85%, the pure zinc is 8.00%, the pure aluminum is 0.65%, the pure copper is 0.5%, Mg-5 wt % Mn alloy is 10.00%, and the FeCrMoBC amorphous alloy particles are 5.00%;

(2) holding the temperature at 300° C. for the FeCrMoBC amorphous alloy particles weighed at step (1);

(3) mixing the pure magnesium, pure zinc, pure aluminum, and Mg-5 wt % Mn alloy weighed at step (1), putting the mixture in a melting and heating furnace under continuous protective gases (mixed gases of $CO_2$ and $SF_6$), gradually raising temperature to 760° C. and melting at a constant temperature for 20 min to obtain a magnesium alloy melt, wherein the volume fraction of $CO_2$ in the protective gases is 99%; and (4) cooling the magnesium alloy melt at step (3) to 610° C., starting mechanical stirring (the stirring speed is 1,000 rpm), continuing to cool it to 590° C., slowly adding the FeCrMoBC amorphous alloy particles obtained at step (2), holding for 5 min after mixing evenly, and cooling the crucible with water to obtain an amorphous particle-modified ZA81 magnesium alloy surface-gradient composite;

The microstructure diagram of the amorphous particle-modified ZA81 surface-gradient composite in this embodiment is shown in FIG. 5. From FIG. 5, it can be known that after settlement, the amorphous particles show a gradient distribution in a specific thickness.

The semi-solid temperature interval mentioned in Embodiments 1-4 is determined by the following method: according to the magnesium alloy phase diagram, the temperature interval is from the initial solidification temperature (To) to the temperature (Tso) when the weight percentage of the liquid phase in the melt is approximately 50%. The table below shows the semi-solid temperature intervals of magnesium alloys AZ91, AM50, AM60, and ZA81:

| Alloys | $T_0$ (° C.) | $T_{50}$ (° C.) | Weight percentage of the liquid phase in alloy |
|---|---|---|---|
| AZ91 | 600 | 570 | 53% |
| AM50 | 625 | 605 | 46% |
| AM60 | 620 | 600 | 50% |
| ZA81 | 610 | 590 | 51% |

Above the specific embodiments of the present invention are described in details in conjunction with accompanying drawings, but the present invention is not limited to the above embodiments. Variations can be made within the knowledge of those of ordinary skill in the art without departing from the spirit of the present invention.

What is claimed is:

1. A method for preparing amorphous particle-modified magnesium alloy surface-gradient composites, wherein the method comprises steps of:

S1 weighing pure magnesium, pure zinc, pure aluminum, pure copper, Mg-5 wt % Mn alloy, and FeCrMoBC amorphous alloy particles;

S2 holding the temperature at 150~350° C. for the FeCrMoBC amorphous alloy particles weighed at step (1);

S3 mixing the pure magnesium, pure zinc, pure aluminum, pure copper, and Mg-5 wt % Mn alloy weighed at step (1), putting the mixture in a melting and heating furnace under continuous protective gases, gradually raising temperature to 720~760° C. and melting at a constant temperature for 15~25 min to obtain a magnesium alloy melt; and S4 cooling the magnesium alloy melt obtained at step (3) to 600~635° C., starting mechanical stirring till the temperature is cooled to 570~615° C., slowly adding the FeCrMoBC amorphous alloy particles obtained at step (2), holding for 2~5 min after mixing evenly, and cooling the crucible with water to obtain an amorphous particle-modified magnesium alloy surface-gradient composite.

2. The method for preparing amorphous particle-modified magnesium alloy surface-gradient composites according to claim 1, wherein supposing that the total mass of the raw materials at step (1) is 100%, the pure magnesium is 72.85~85.35%, the pure zinc is 7.50~8.50%, the pure aluminum is 0.65~9.50%, the pure copper is 0.45~0.55%, the Mg-5 wt % Mn alloy is 9.0~11.0%, and the FeCrMoBC amorphous alloy particles are 2.00~8.00%.

3. The method for preparing amorphous particle-modified magnesium alloy surface-gradient composites according to claim 1, wherein the protective gases at step (3) are mixed gases of CO2 and SF6.

4. The method for preparing amorphous particle-modified magnesium alloy surface-gradient composites according to claim 3, wherein the volume fraction of CO2 in the protective gases at step (3) is 99%.

5. The method for preparing amorphous particle-modified magnesium alloy surface-gradient composites according to claim 1, wherein the mechanical stirring speed at step (3) is 350~1000 rpm.

* * * * *